United States Patent [19]

Beverly et al.

[11] 4,187,502

[45] Feb. 5, 1980

[54] SWIMMING POOL ALARM SYSTEM

[76] Inventors: Frank O. Beverly, 2396 Via Camino, Carmichael, Calif. 95608; Karl H. Nagel, 1025 NW. 66th Ter., Margate, Fla. 33063

[21] Appl. No.: 859,301

[22] Filed: Dec. 12, 1977

[51] Int. Cl.[2] ..... G08B 13/22

[52] U.S. Cl. ..... 340/566; 340/515; 367/93

[58] Field of Search ..... 340/566, 8 S, 514, 515

[56] References Cited

U.S. PATENT DOCUMENTS

| | | | |
|---|---|---|---|
| Re. 28,915 | 7/1976 | Ogden et al. | 340/514 |
| 3,009,137 | 11/1961 | Cassell | 340/515 |
| 3,189,883 | 6/1965 | Lucas et al. | 340/515 |
| 3,273,138 | 9/1966 | Kolm | 340/566 |
| 3,636,544 | 1/1972 | Codina | 340/566 |
| 3,969,712 | 7/1976 | Butman et al. | 340/566 |
| 4,013,990 | 3/1977 | Devine | 340/8 S |

*Primary Examiner*—Glen R. Swann, III

*Attorney, Agent, or Firm*—Limbach, Limbach & Sutton

[57] ABSTRACT

A swimming pool alarm system of the pressure transducer type employs an omnidirectional hydrophone which is held immersed in the swimming pool by means that mechanically decouples the hydrophone.

14 Claims, 5 Drawing Figures

SWIMMING POOL ALARM SYSTEM

BACKGROUND OF THE INVENTION

This invention relates to swimming pool alarm systems and more particularly to that type of system where the detection means is an immersed pressure transducer.

Prior art swimming pool alarm systems have generally been of two types: those having electrical contacts made or broken as a result of physical movement caused by surface wave action and those employing transducers.

Representative of the former type of systems are the systems of the following U.S. Pat. Nos.: 4,017,842 to Vineyard, Apr. 12, 1977 (arm with float responds to wave height); 3,778,803 to Jahn, Dec. 11, 1973 (position sensitive switch within floating buoy); 3,504,145 to Layher, Mar. 31, 1970 (buoyant float within buoyant container operates contacts); 3,953,843 to Codina, Apr. 27, 1976 (floating housing has one contact above water and one below); and 3,786,469 to Massaro et al, Jan. 15, 1974 (floating housing with hanging bob contacting conical member). Such systems relying on surface wave action and/or physical quiescence are susceptible to false indicators such as wind or contact with objects.

In one transducer system described in U.S. Pat. No. 3,810,146 to Lieb, May 7, 1974, a transducer is mounted in the wall of a swimming pool and is responsive to ultrasonic signals from special transmitters that must be affixed to children or others that might improperly enter the pool in order to detect their presence. Such a system would fail to detect an unequipped person.

In U.S. Pat. No. 3,969,712 to Butman et al, July 13, 1976, a transducer facing downward from the under surface of a floating housing which also contains circuitry to filter out lower frequency signals received by the transducers, integrate the signals and activate a bell when a threshold is reached. Such a system is susceptible to surface wave action and physical contact with the housing. Also, the transducer orientation likely results in directionality in transducer response. Moreover, the transducer will also be responsive to the natural resonant frequency of the immersed housing. The transducer location also requires that a relatively large area in the housing under surface be sealed against water.

SUMMARY OF THE INVENTION

In accordance with the teachings of the present invention a swimming pool alarm system is provided which overcomes these and other problems in the prior art.

The present system is of the transducer type and provides for an immersed transducer acoustically decoupled from its holding means. Consequently, surface wave action and physical contact with objects such as wind blown debris, the walls of the pool, or the like are minimized. Omnidirectional response to under water pressure waves detects with high accuracy the entrance of objects into the pool. Circuitry, including an adjustable level control to accommodate pool size and sensitivity to small objects, detects an under water object exceeding the adjustable threshold and sets an alarm.

In one preferred embodiment, the transducer is held suspended below a floating housing. In a second preferred embodiment, the transducer is held immersed in the pool by a bracket attached to the pool enclosure. The alarm can be located remotely to the pool in order to assure its observation within a house, for example.

Radio or wire connection can be provided and at least a portion of the circuitry can be located remotely from the transducer.

According to the present system, unique testing means are also provided to assure the user that the system is functioning properly.

These and other features and advantages of the present invention will be further appreciated as the detailed description is read in conjunction with the drawings.

DESCRIPTION OF THE PREFERRED EMBODIMENTS

Figure 1:
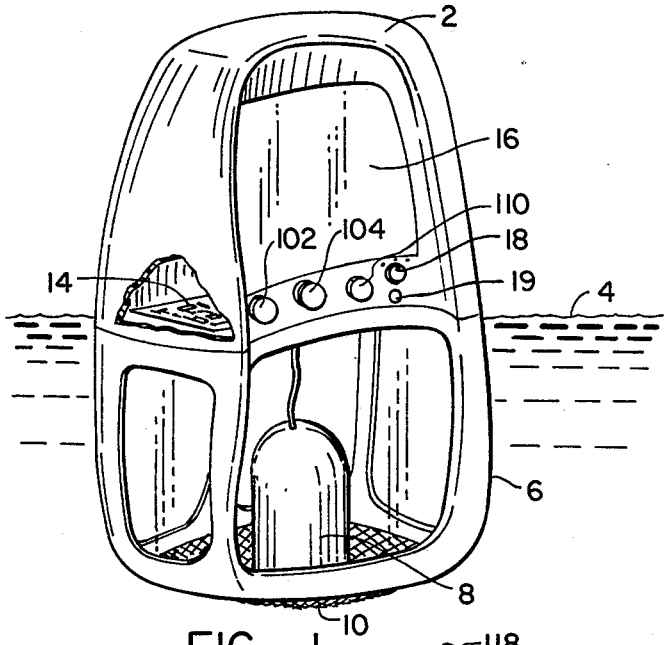
FIG. 1 is a perspective view of one embodiment of the invention in which the transducer is suspended by a floating housing.

Referring now to FIG. 1 in which embodiment a transducer is suspended by a floating housing. A buoyant housing 2 formed from suitable corrosion resistant materials, such as plastic, floats on the surface 4 of a swimming pool. Housing 2 includes an upper portion which rides above the water level and a lower portion extending below the water level, the latter portion substantially open to the water and having frame members 6 defining generally a protected area in which the transducer 8 is suspended by a net 10. Transducer 8 may be a conventional ceramic piezoelectric hydrophone, for example. Such a hydrophone having a frequency response in the order of 100 Hz through 10 kilohertz and a sensitivity of $-97.5$ dbv/$\mu$bar has been found suitable. A cable 12 connects hydrophone 8 to the upper portion of the housing 2 through a small waterproofed opening (not shown). Slack must be provided in the cable so that there is no effective acoustic/mechanic connection between the housing and hydrophone. The net 10 is selected to provide substantial mechanical decoupling between the hydrophone and housing. Other suitable means for mechanically decoupling the hydrophone may be employed. Preferably the hydrophone is held on the order of six inches or more below the water surface to minimize the effect of surface waves. The upper portion of housing 2 contains at least a portion of the system's circuitry, shown generally at 14. A waterproofed openable door 16 permits access to the circuitry. A switch 18 places the device in its on, off or test states. Push button switch 19 resets the unit. Lamps 102 and 104 are for test functions described below. Housing 2 preferably contains a transmitter, antenna, sufficient circuitry, and a battery to transmit an alarm signal to a remote alarm unit. However, a wired connection can be provided to the remote alarm unit, in which case the power source and at least a portion of the circuitry to produce an alarm signal may be located other than in the housing 2.

Figure 2:
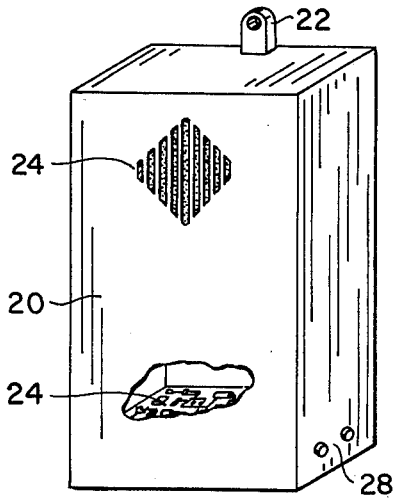
FIG. 2 is a perspective view of the remote alarm unit.

In FIG. 2 a remote alarm unit is shown as including an enclosure 20 having a hook 22 for fastening to a wall.

A siren (not shown) is located behind a grill 24 for providing an audible alarm. Other means for providing a discernible alarm may be provided, including, for example, lights. Enclosure 20 includes an antenna, receiver and circuitry for driving the siren shown generally at 24. The alarm unit is reset by push button 19 in the pool unit. Terminals 28 provide connections for additional remotely located sirens.

Figure 3:
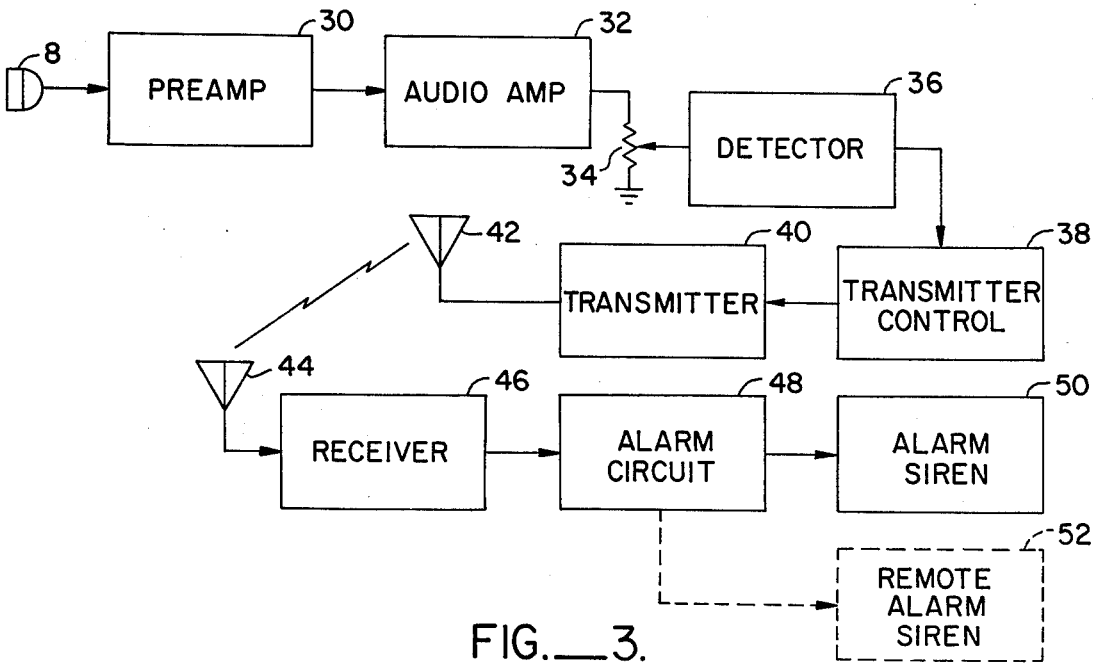
FIG. 3 is a block diagram of one embodiment of the overall system.

Referring to FIG. 3, one embodiment of the system is shown in which radio connection is employed. The hydrophone 8 has its low level signals amplified by a preamplifier 30 and by an audio amplifier 32. A detector 36 provides an output in response to a particular audio level. The threshold level is adjusted by a potentiometer 34 which is set by the system user. The detector output, the alarm signal, is applied to the transmitter control 38 which controls the transmitter 40 to continuously transmit (until reset) a signal via antenna 42 to the receiver antenna 44 and receiver 46. The received signal is applied to an alarm circuit 48 that continuously actuates the alarm siren 50 until reset. One or more remote alarm sirens 52 may also be used.

Devices 32, 34, 36, 38, 40 and 42 may be located inside the housing 2 of FIG. 1 and devices 46, 48 and 50 may be located inside enclosure 20 of FIG. 2. At a minimum, the preamplifier 30 will necessarily be located close to or unitary with hydrophone 8. A wire connection can be provided from preamp 30 to audio amplifier 32 so that that device and those following it can be located remote from housing 2. Further, a wire connection between detector 36 and alarm 48 can be provided in place of a radio connection. However, in the case of a floating housing, a non-wired connection to the housing 2 is believed preferable in practical applications.

Figure 4:
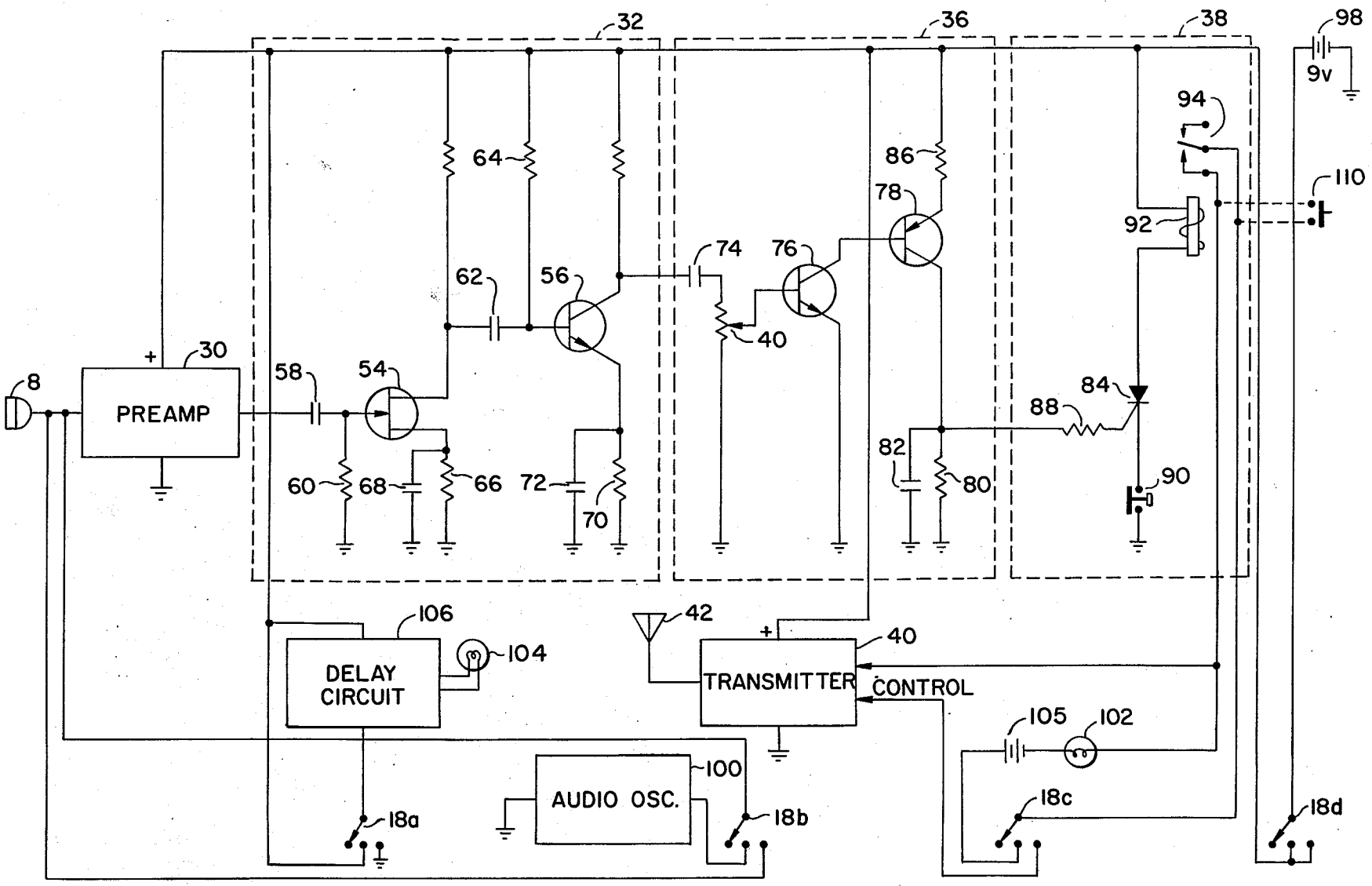
FIG. 4 is a partially block circuit diagram of the hydrophone through transmitter portion of the block diagram of FIG. 3.

FIG. 4 shows the portion of the block diagram of FIG. 3 through device 42 in greater detail. Audio amplifier 32 includes two stages: a N-channel FET 54 and a NPN transistor 56 with interstage coupling via capacitors and resistors 58, 60 and 62, 64, respectively. Resistors and capacitors 66, 68 and 70, 72 provide bias. Capacitor 74 couples the amplified audio to the two stage detector 36. Potentiometer 40 adjusts the signal level to the first stage, a NPN transistor 76 which is direct coupled to the second stage, a PNP transistor 78. Bias is provided by resistor 80 and capacitor 82. A signal at the base of transistor 76 sufficient to cause it to conduct will drive transistor 78 into conduction to cause SCR 84 to fire by means of the voltage divider arrangement of resistors 86, 88 and 80. The SCR remains fired until normally closed reset button 90 is actuated. While fired, the SCR 84 causes current to flow in winding 92 of relay 94 to selectably actuate transmitter 40. Positive voltage of nine volts, for example, is selectably applied on line 96 to power the various devices.

Switch 18 places the system in its off, test and on states, from left to right, respectively. In the left-hand (off) state no power is applied from the battery 98. In the center (test) position an audio oscillator 100 applies an audio signal to preamp 30 and the relay 94 contacts are connected to a lamp 102 and battery 105 to provide a visual indication that the circuitry is operating. At the same time a capacitor (not shown) charges in delay circuit 106. Upon switching to the right position (on), the capacitor is discharged, lighting lamp 108 for a few seconds to verify switching to the on mode. Thus, whenever switched from off to on the lamps 102 and 108 will sequentially light to indicate proper operation.

In order to test the remote alarm unit and transmitter, an override push button can be actuated to verify their operation.

Figure 5:
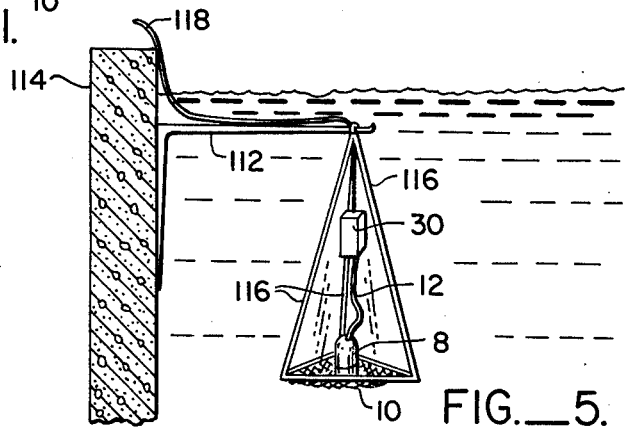
FIG. 5 is a perspective view of a further embodiment of the present system in which the transducer is suspended by a bracket fixed to the swimming pool wall.

In FIG. 5, the hydrophone 8 is held by a net suspended by arms 116 and cantilevered bracket 112 fixed to the swimming pool wall 114. The preamplifier 30 is located adjacent to hydrophone 8 by cable 12. A cable 118 connects the preamplifier output to the audio amplifier 32 and remaining circuitry. In this embodiment, particularly, a direct wire connection can be provided to the alarm unit without the use of radio devices.

Numerous variations of the described embodiments will be apparent to those of ordinary skill in the art. The invention is therefore to be limited only by the scope of the appended claims.

We claim:

1. A swimming pool alarm system comprising water-resistant hydrophone means for generating signals in response to received pressure variations in a range of frequencies between approximately 100 Hz and 10 kHz, means for holding said hydrophone means immersed in a swimming pool, said holding means substantially mechanically decoupling said hydrophone means, whereby said hydrophone means is responsive to substantially only pressure waves in the swimming pool, circuit means connected to said hydrophone means for generating an alarm signal when the signals from said hydrophone means exceed a predetermined threshold, and alarm means for generating a physically discernible alarm in response to said alarm signal.

2. The combination of claim 1 wherein said holding means includes a waterproof housing floatable in a swimming pool.

3. The combination of claim 1 wherein said holding means includes bracket means affixable to a portion of a swimming pool.

4. The combination of claim 1 further comprising means for protecting said hydrophone means from physical contact with the walls or floor of a swimming pool or with objects in a swimming pool.

5. The combination of claim 1 wherein said predetermined threshold is adjustable.

6. The combination of claim 1 wherein said circuit means and alarm means are located remotely from the swimming pool and said hydrophone means includes a hydrophone connected to a preamplifier and means for connecting said preamplifier to said circuit means.

7. The combination of claim 2 wherein said alarm means is located remotely from the swimming pool.

8. The combination of claim 7 wherein said circuit means is located in said housing and said circuit means includes a radio transmitter for transmitting said alarm signal and said alarm means includes a radio receiver for receiving said alarm signal.

9. The combination of claim 7 wherein said circuit means includes means for electrically connecting said alarm means to said hydrophone means.

10. The combination of claim 1 wherein said hydrophone means includes an omnidirectional hydrophone.

11. The combination of claim 1 wherein said alarm means generates a continual alarm until reset.

12. The combination of claim 2 wherein said housing is formed from corrosion resistant materials.

13. The combination of claim 1 further comprising means for testing said circuit means to verify the proper operation thereof, said means for testing including means for applying a test audio signal to said circuit.

14. The combination of claim 1 further comprising means for jointly testing said circuit means and alarm means to verify the proper operation thereof, said means for testing including means for applying a test audio signal to said circuit.

* * * * *